US012637186B2

(12) United States Patent
Lindkvist et al.

(10) Patent No.: US 12,637,186 B2
(45) Date of Patent: May 26, 2026

(54) METHOD OF IDENTIFYING A VESSEL, A VESSEL IDENTIFYING DEVICE AND A FLOATING OBJECT AND LAND INSTALLATION COMPRISING A VESSEL IDENTIFYING DEVICE

(71) Applicant: ABB Schweiz AG, Baden (CH)

(72) Inventors: Rickard Lindkvist, Västerås (SE); Jonas Linder, Mellerud (SE)

(73) Assignee: ABB Schweiz AG, Baden (CH)

( * ) Notice: Subject to any disclaimer, the term of this patent is extended or adjusted under 35 U.S.C. 154(b) by 164 days.

(21) Appl. No.: 18/413,375

(22) Filed: Jan. 16, 2024

(65) Prior Publication Data

US 2024/0239452 A1 Jul. 18, 2024

(30) Foreign Application Priority Data

Jan. 17, 2023 (EP) ..... 23151968

(51) Int. Cl.
*B63B 79/40* (2020.01)
*B63B 79/10* (2020.01)

(52) U.S. Cl.
CPC ..... *B63B 79/40* (2020.01); *B63B 79/10* (2020.01); *B63B 2213/02* (2013.01)

(58) Field of Classification Search
CPC ..... G08G 3/00; G01C 21/203; B63B 79/40; B63B 79/10; B63B 2213/02
See application file for complete search history.

(56) References Cited

U.S. PATENT DOCUMENTS

| | | | | |
|---|---|---|---|---|
| 9,659,501 | B2 * | 5/2017 | Lee | G08G 3/02 |
| 12,154,054 | B2 * | 11/2024 | Naslavsky | G06Q 10/0635 |
| 2016/0290812 | A1 * | 10/2016 | Guichoux | B63B 79/30 |
| 2018/0123680 | A1 * | 5/2018 | Stolte | H04B 7/18513 |
| 2019/0253130 | A1 | 8/2019 | Bagnall et al. | |
| 2020/0012283 | A1 * | 1/2020 | Nguyen | G05D 1/0206 |
| 2023/0086883 | A1 * | 3/2023 | Sovran | B63B 79/10 701/424 |

FOREIGN PATENT DOCUMENTS

KR 1020180076187 A 7/2018

OTHER PUBLICATIONS

Ahmed et al., A Spatio-Temporal Track Association Algorithm Based on Marine Vessel Automatic Identification System Data, 2022, IEEE, p. 20783-20797 (Year: 2022).*

(Continued)

*Primary Examiner* — McDieunel Marc
(74) *Attorney, Agent, or Firm* — Whitmyer IP Group LLC

(57) ABSTRACT

A method of identifying a vessel as well as a vessel identifying device and a floating object and land installation including such a vessel identifying device. The vessel identifying device includes a processor operative to obtain a position of a vessel being sensed by a sensor, assign an identity to the vessel, which identity is assigned according to an identity assignment scheme of at least a part of a maritime tracking system, which maritime tracking system is an Automated Identification System (AIS), and provide an identification of the vessel according to the maritime tracking system, the identification including the assigned identity and the position of the vessel, and order a transmitter to transmit the identification of the vessel.

20 Claims, 6 Drawing Sheets

(56) References Cited

OTHER PUBLICATIONS

Molina-Padrón et al., Monitoring in Near-Real Time for Amateur UAVs Using the AIS, 2020, IEEE, p. 33380-33390 (Year: 2020).*
Shyshkin, Cybersecurity Providing for Maritime Automatic Identification System, 2022, IEEE, p. 1-5 (Year: 2022).*
Tetreault, Use of the Automatic Identification System (AIS) for maritime domain awareness (MDA), 2005, IEEE, p. 1-5 (Year: 2005).*
Sermi, Francesco, et al.; "A Maritime Radar Network for Surface Traffic Control Based on Service Vessels"; 2013 14th International Radar Symposium (IRS), vol. 1; IEEE; Dresden, Germany; Jun. 19, 2013; 6 Pages.
Extended European Search Report; Application No. 23151968.7; Completed: Jun. 30, 2023; Issued: Jul. 10, 2023; 9 Pages.

* cited by examiner

METHOD OF IDENTIFYING A VESSEL, A VESSEL IDENTIFYING DEVICE AND A FLOATING OBJECT AND LAND INSTALLATION COMPRISING A VESSEL IDENTIFYING DEVICE

TECHNICAL FIELD

The invention relates to a method of identifying a vessel as well as to a vessel identifying device and a floating object and land installation comprising such a vessel identifying device.

BACKGROUND

Safe navigation is today one of the most important aspects in shipping. To be able to safely navigate in high traffic areas, a captain needs to follow a safe route and avoid collisions with other ships and vessels. To avoid such collisions the captain needs to know where in the immediate environment all other vessels are located. Onboard sensors, such as radar or Lidar, and Automatic Identification System (AIS) signals from other ships are common ways to locate the surrounding vessels. Unfortunately, not all vessels have AIS transponders, e.g. smaller ships and ships involved in illegal activities that are trying to avoid detection. Moreover, the onboard sensors typically rely on a free line-of-sight. Vessels that are lacking AIS transponders and that are hidden behind obstacles such as islands or other bigger ships, cannot be detected.

There is thus a need for improving safety in a marine application where there are vessels that lack a maritime tracking system such as AIS.

SUMMARY

One object of the invention is therefore to improve safety in a marine environment where there are vessels that do not use a maritime tracking system.

This object is according to a first aspect achieved by a vessel identifying device comprising:

- a processor operative to:
  - obtain a position of the vessel being sensed by a sensor,
  - assign an identity to the vessel, which identity is assigned according to an identity assignment scheme of at least a part of a maritime tracking system, which maritime tracking system is AIS,
  - provide an identification of the vessel according to the maritime tracking system, the identification comprising the assigned identity and the position of the vessel, and
  - order a transmitter to transmit the identification of the vessel.

The object is according to a second aspect achieved through a method of identifying vessels, the method being performed by a vessel identifying device and comprising:

- obtaining a position of a vessel sensed by a sensor,
- assigning an identity to the vessel, which identity is assigned according to an identity assignment scheme of at least a part of a maritime tracking system, which maritime tracking system is AIS, and
- order a transmitter to transmit an identification of the vessel according to the maritime tracking system, the identification comprising the assigned identity and the position of the vessel.

AIS is an acronym for automatic identification system. AIS is also a standardised maritime tracking system. The identity assignment scheme may be applied for a part of the maritime tracking system, such as an area or region in which the vessel identifying device is located. Alternatively, the identity assigning scheme may be global and used for the whole maritime tracking system.

The identity assigning scheme may include assigning identities that differ from identities assigned to vessels by the maritime tracking system. The assigned identities may be identities that differ from static identities assigned to vessels by the maritime tracking system. The assigned identities may thereby also differ from identities used for vessels that are equipped with AIS transponders.

The sensor may be associated with the vessel identifying device. The vessel identifying device may comprise the sensor, which may thereby be operative to sense the position of a vessel.

In this case, the obtaining of the position of the vessel may comprise sensing, by the at least one sensor, the position of the sensor.

The vessel identifying device may additionally comprise more than one sensor. The sensors that are used may e.g. comprise a radar, a lidar and/or a camera.

The vessel identifying device may additionally comprise the transmitter.

In this case the method may additionally comprise transmitting, by the transmitter, the identification of the vessel according to the maritime tracking system.

The transmitting may be a transmitting over radio or through some other communication channel.

According to one variation of the first aspect, the processor is further operative to obtain a speed and/or a direction of movement of the vessel and where the identification comprises the obtained speed and/or direction of the vessel.

According to a corresponding variation of the second aspect, the method further comprises obtaining a speed and/or a direction of movement of the vessel and where the transmitting comprises transmitting the obtained speed and/or direction of the vessel.

The speed and/or direction may be obtained through being determined based on at least two sensed vessel positions.

The positions may be sensed at corresponding points in time. The determining of the speed may additionally be made based on the points in time at which the positions are sensed.

Alternatively, one or more sensors that can directly measure the speed/direction may be used.

According to another variation of the first aspect, the processor is further operative to fetch an identity in an identity space of the identity assignment scheme and to, when assigning an identity to the vessel, assign the fetched identity to the vessel.

According to a corresponding variation of the second aspect, the method further comprises fetching an identity in an identity space of the identity assignment scheme, wherein the assigning comprises assigning the fetched identity to the vessel.

According to yet another variation of the first aspect, the processor is further operative to query a server associated with the maritime tracking system, receive the identity as a response to the query and when assigning an identity to the vessel, is operative to assign the received identity to the vessel.

According to a corresponding variation of the second aspect, the method further comprises querying a server associated with the maritime tracking system and receiving the identity as a response to the query, wherein the assigning comprises assigning the received identity to the vessel.

According to a further variation of the first aspect, the transmitter is operative to transmit the identification as a radio signal on a frequency assigned to the maritime tracking system.

According to a corresponding variation of the second aspect, the transmitting comprises transmitting the identification as a radio signal on a frequency assigned to the maritime tracking system.

According to another variation of the first aspect, the transmitter is operative to transmit the identifier to a central server that collects and stores identifiers of vessels for at least a part of the world.

According to a corresponding variation of the second aspect, the transmitting comprises transmitting the identifier to a central server that collects and stores identifiers of vessels for at least a part of the world.

The detected position of the vessel may be a local position that is related to a position of the vessel identifying device.

In this case the processor may, according to a further variation of the first aspect, be further operative to determine a global position of the vessel based on the position of the vessel identifying device and where the position in the transmitted identification comprises the global position of the vessel.

In this case, the method may, according to a corresponding variation of the second aspect, further comprise determining a global position of the vessel based on the position of the vessel identifying device and where the position in the transmitted identification comprises the global position of the vessel.

According to another variation of the first aspect, the processor is further operative to obtain at least one vessel property. In this case the processor is only operative to perform the assigning and the transmitter is only operative to perform the transmitting in case the vessel property fulfils a corresponding vessel property criterion.

According to a corresponding variation of the second aspect, the method further comprises obtaining at least one vessel property and only performing the assigning and transmitting in case the vessel property fulfils a corresponding vessel property criterion.

The vessel property may be a physical property of the vessel. It may for instance be a quantifiable physical property, a physical quantity, or an observable.

According to yet another variation of the first aspect, the processor, when obtaining at least one vessel property, is operative to estimate a size of the vessel. For this vessel size, the corresponding property criterion may be a size limit of the vessel. In this case the vessel property may fulfil the vessel property criterion in case the estimated vessel size is within a vessel size limit.

According to a corresponding variation of the second aspect, the obtaining of at least one vessel property comprises estimating a size of the vessel for which the corresponding vessel property criterion is a size limit of the vessel, and where the vessel property may fulfil the vessel property criterion in case the estimated vessel size is within a vessel size limit.

The vessel size limit may comprise a vessel length limit and/or a vessel width limit. In this case the assigning and transmitting may only be performed in case the length and/or width is within the corresponding limit.

One vessel property may be the speed of the vessel.

For this vessel property a corresponding vessel property criterion is fulfilled if the speed is below a corresponding upper speed threshold. For this vessel property, the vessel property criterion may additionally or instead be fulfilled if the speed is above a lower speed threshold.

A third aspect of the present disclosure is concerned with a floating object comprising the vessel identifying device according to the first aspect. In one variation of the third aspect, the object is a ship. In another variation of the third aspect, the object is a buoy. The object may also be a platform or a floating lighthouse.

A fourth aspect of the present disclosure is concerned with a land installation comprising the vessel identifying device according to the first aspect.

It should be emphasized that the term "comprises/comprising" when used in this specification is taken to specify the presence of stated features, integers, steps, or components, but does not preclude the presence or addition of one or more other features, integers, steps, components, or groups thereof.

BRIEF DESCRIPTION OF THE DRAWINGS

The invention will now be described in more detail in relation to the enclosed drawings, in which.

DETAILED DESCRIPTION

In the following description, for purposes of explanation and not limitation, specific details are set forth such as particular architectures, interfaces, techniques, etc. in order to provide a thorough understanding of the invention. However, it will be apparent to those skilled in the art that the invention may be practiced in other embodiments that depart from these specific details. In other instances, detailed descriptions of well-known devices, circuits and methods are omitted so as not to obscure the description of the invention with unnecessary detail.

The invention is generally directed towards navigation assistance employing a maritime tracking system, which maritime tracking system is AIS, where AIS is as an acronym for automatic identification system. The invention is more particularly directed towards how to assist such navigation when there are vessels that do not employ the maritime tracking system.

Figure 1:
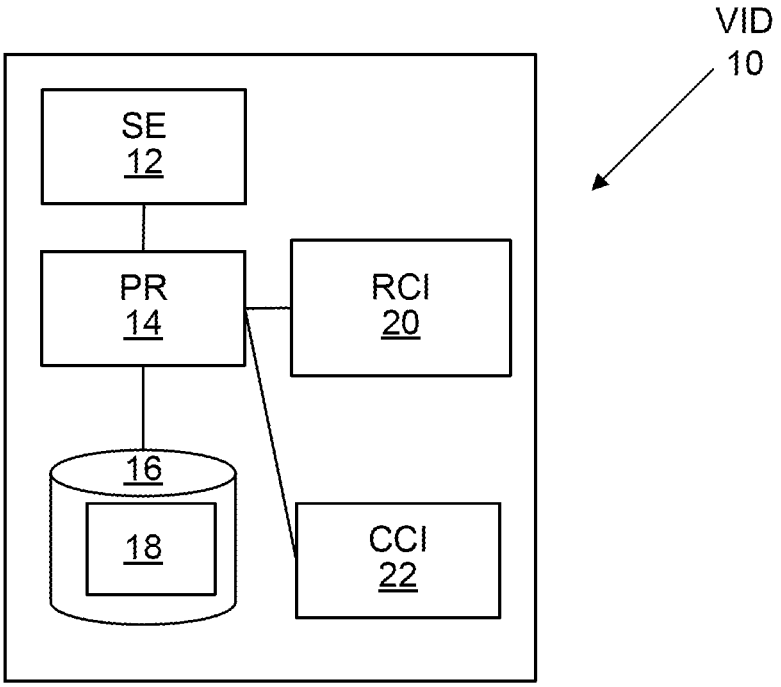
FIG. 1 schematically shows a first way of realizing a first vessel identifying device.

FIG. 1 schematically shows one realization of a first vessel identifying device VID 10. In the present example, the first vessel identifying device 10 comprises at least one sensor. In this case it comprises a first sensor SE 12, which may be a radar (Radio Detection And Ranging), a Lidar (Light Detection And Ranging) or a camera. There is also a processor PR 14 and a data storage 16 with computer program instructions 18 that, when executed by the processor 14, implements a vessel identifying function. There is also a first communication interface, here realized as a radio communication interface RCI 20 and a second communication interface, here realized as a computer communication interface 22. The radio communication interface 20 is also a transmitter that transmits radio signals. It should be realized that it is possible that the first vessel identifying device 10 only comprises the radio communication interface and not the computer communication interface.

It should be realized that the sensor need not be a part of the first vessel identifying device. It may however be associated with the first vessel identifying device. The sensor may for instance be excluded from the first vessel identifying device if a ship that is already equipped with a sensor is retrofit with the first vessel identifying device. It is also possible that the radio communication interface in the same way is excluded from the first vessel identifying device.

The first vessel identifying device 10 may thus comprise a processor 14 with associated program memory 16 including computer program code 18 for implementing the vessel identifying function.

Figure 2:
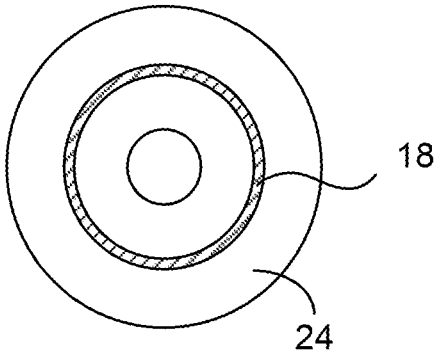
FIG. 2 shows a computer program product in the form of a CD ROM with computer program code used to implement a vessel identifying function of the first vessel identifying device, FIG. 3 schematically shows a land installation comprising the first vessel identifying device, FIG. 4 schematically shows a buoy comprising the first vessel identifying device, FIG. 5 schematically shows a ship comprising the first vessel identifying device that transmits an identification, FIG. 6 schematically shows the first vessel identifying device communicating with an identity handling server via the Internet, FIG. 7 schematically shows a chart with a number of ships equipped with a maritime tracking system as well as vessels lacking a maritime tracking system.

A computer program may also be provided via a computer program product, for instance in the form of a non-transitory computer readable storage medium or data carrier, like a CD ROM or a memory stick, carrying such a computer program with the computer program code, which will implement the vessel identifying function when being loaded into a processor. One such computer program product in the form of a CD ROM 24 with the above-mentioned computer program code 18 is schematically shown in FIG. 2.

There are a number of objects in which the first vessel identifying device may be provided.

Figure 3:
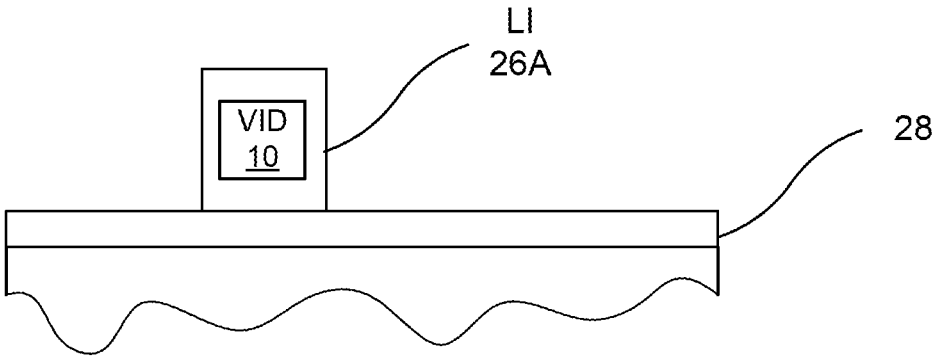

One such object is a land installation. FIG. 3 shows a land installation LI 26A comprising the first vessel identifying device 10. In the example the land installation 26A is provided on a quay 28 of a harbour or port. However, it should be realized that other locations are possible, such as on islands close to navigational paths, such as fairways.

The first vessel identifying device may also be provided in a floating object.

Figure 4:
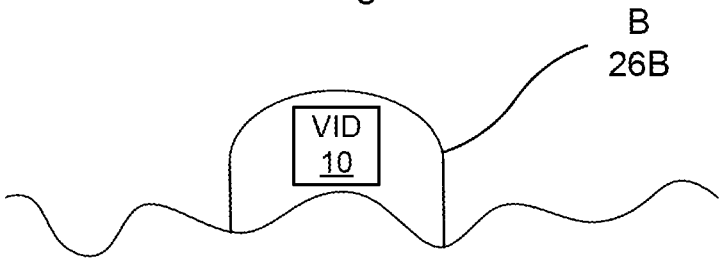
Figure 5:
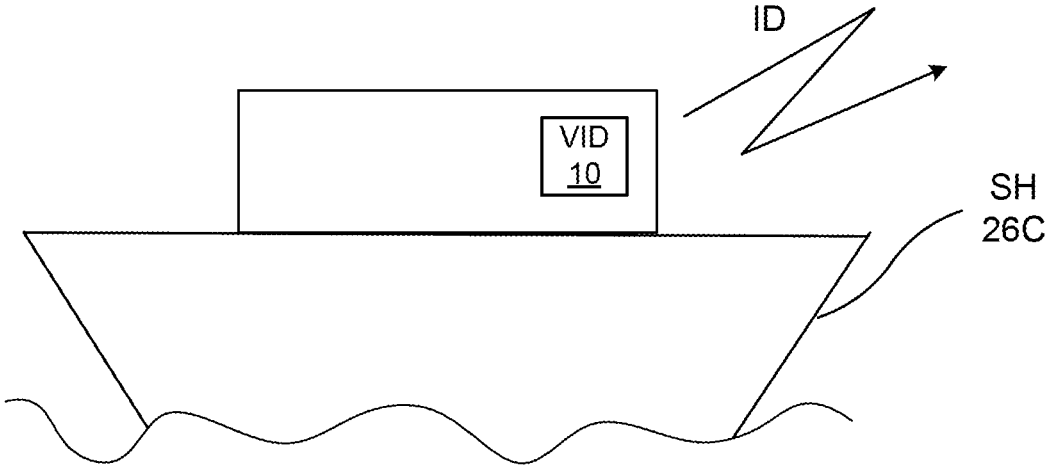

FIG. 4 shows a first type of floating object in the form a buoy B 26B that comprises the first vessel identifying device 10. FIG. 5 shows a second type of floating object in the form a ship SH 26C that comprises the first vessel identifying device 10. The first vessel identifying device 10 on the ship 26C is also shown to be wirelessly transmitting a vessel identification ID, which is transmitted using the previously mentioned radio communication interface. It should be realized that also other floating objects are possible, such as floating platforms or floating lighthouses.

Figure 6:
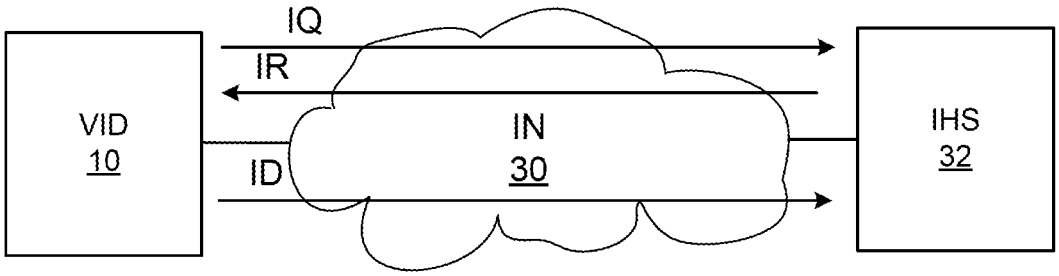

As can be seen above the first vessel identifying device 10 may comprise a computer communication interface. This is used for communication with an identity handling server, which is a server associated with the AIS system. The identity handling server may additionally be a central server that collects and stores identifiers of vessels for at least a part of the world. FIG. 6 schematically shows the first vessel identifying device VID 10 communicating with the identity handling server HIS 32 via a communication network such as the Internet IN 30. It should be realized that other networks could also be used. The first vessel identifying device 10 is more particularly shown as sending an identifier query IQ to the identity handling server 32, receiving an identifier response IR from the identity handling server 32 and sending an identification IN to the identity handling server 32.

As was mentioned earlier the first vessel identifying device is provided for assisting navigation.

Figure 7:
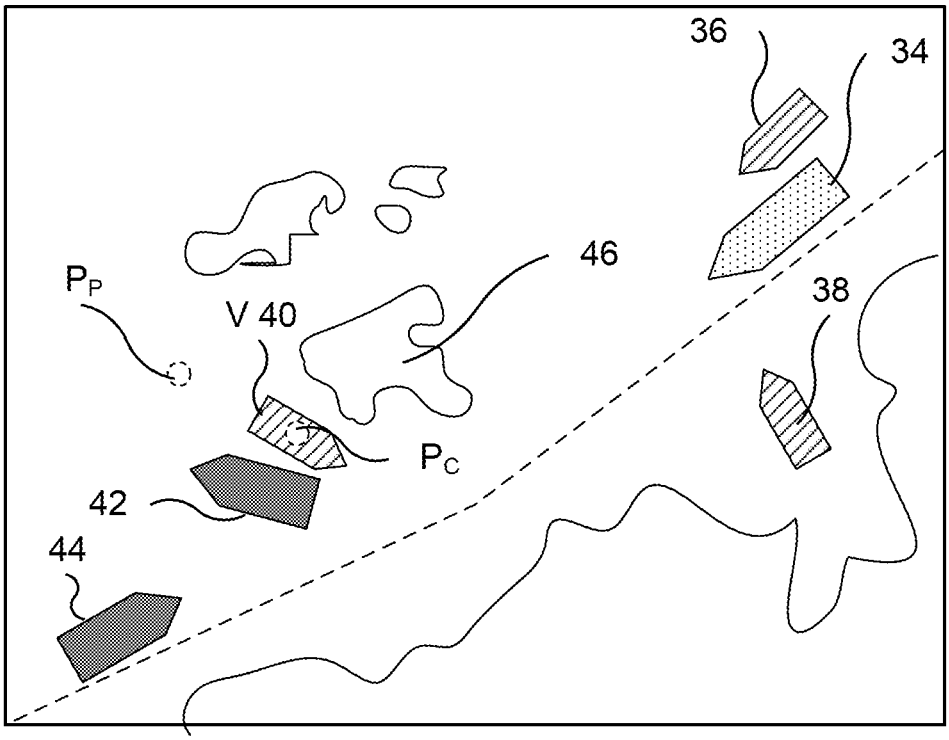

FIG. 7 shows an exemplary chart that may be useful for understanding the need for the first vessel identifying device 10. In the chart there is a first ship 34. The first ship 34 uses AIS. The first ship 34 also travels along a fairway, which fairway passes by a group of islands. Behind a first of the islands 46 in the group there are two vessels, a first vessel V 40 and a second vessel 42, which vessels are hidden from the first ship 34. The first vessel 40 is shown as being located at a current position, $P_C$, which is a position being sensed at a current point in time. Also, a previous position $P_P$ that it occupied at a previous point in time is indicated in the chart.

The first vessel 40 does not use AIS. However, the second vessel 42, which is a ship, does use AIS. There are also two other vessels 36 and 38 that also do not employ AIS as well as a further ship 44 that uses AIS and that also follows the fairway in the opposite direction compared with the first ship 34.

Safe navigation is today one of the most important aspects in shipping. To be able to safely navigate in high traffic areas, a captain needs to follow a safe route and avoid collisions with other ships. To avoid other ships, the captain needs to know where in the immediate environment all other vessels are located. Onboard sensors, such as radar, and AIS signals from other ships are common ways to locate the surrounding vessels. Unfortunately, not all vessels have AIS transponders, e.g. smaller ships and ships involved in illegal activities that are trying to avoid detection. Moreover, the onboard sensors typically rely on a free line-of-sight. Vessels that are lacking AIS transponders and that are hidden behind obstacles such as islands or other bigger ships cannot be detected. One example scenario is presented in the previously mentioned FIG. 7.

It can be seen in FIG. 7, that the first vessel 40 is not in the line-of-sight of the first ship 34. As the first vessel 40 does not use AIS, the first ship 34 may very well collide with it.

Although the further vessels 36 and 38 do not use AIS, they are visible to the first ship 34 and collision can therefore be avoided. The second vessel 42 and the further ship 44 both use AIS. Therefore, the first ship 34 does not risk colliding with them.

Furthermore, the first vessel 40 is only visible from the second vessel 42. This means that there is also a risk for a collision with the further ship 44.

Aspects of the present disclosure are directed towards improving on this situation, which is done using the first vessel identifying device 10. The first vessel identifying device 10 may be provided on a ship that uses the maritime navigational system, such as the second vessel 42 in FIG. 7. It may also be provided in a buoy, for instance one that is strategically placed along the fairway. It may also be provided as a land installation, for instance on the first island 46.

Figure 8:
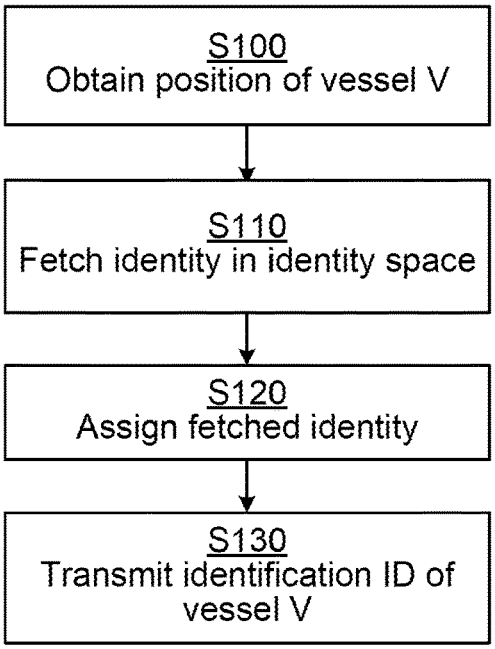
FIG. 8 shows a flow chart of a number of method steps in a first embodiment of a method for identifying vessels.

How such improvement in safety may be achieved according to a first embodiment, will now be described with reference being made to FIG. 8, which shows a number of steps in a flow chart of the method of identifying vessels, which method is carried out by the first vessel identifying device 10.

In the example of FIG. 7, the first vessel identifying device 10 may be provided on the second vessel 42 or as a land installation on the first island 46.

The sensor 12 of the first vessel identifying device 10 senses surrounding vessels, such as the first vessel V 40 and the further ship 44. The sensor 12 more particularly senses the position of the first vessel 40, which in this case is done through sensing the current position $P_C$ of the first vessel 40. The position is then sent to the vessel identifying function, which in this way obtains the position of the first vessel 40 being sensed by the sensor 12, S100.

The sensed position of the first vessel 40 may be a local position that is related to a position of the first vessel identifying device 10, which position of the first vessel identifying device 10 may be a global position, such as a position in longitude and latitude. In this case the vessel identifying function may determine a global position of the first vessel 40 based on the global position of the first vessel identifying device 10.

The vessel identifying function also fetches an identity in an identity space of an identity assignment scheme used in the AIS tracking system, S110, which is also a standardised maritime tracking system. The AIS tracking system may provide a "local identity", such as a local identity number to be used in a local area, and the first vessel identifying device 10 may pick an available such identity in the identity space. The identity space may additionally comprise identities that differ from static identities assigned to vessels by the maritime tracking system. The identities in the identity space may thus differ from identities used for vessels that are equipped with AIS transponders. The vessel identifying function of the first vessel identifying device 10 then assigns the fetched identity to the first vessel 40, S120. Thereby the assigned identity is an identity that is assigned according to the identity assigning scheme of at least a part of the maritime tracking system, where in this case the identity assignment scheme is applied for a part of a maritime tracking system, such as an area or region in which the first vessel identifying device 10 is located. In this way the vessel identifying function provides an identification of the first vessel 40 according to the AIS system, where the identification comprises the assigned identity and the position of the first vessel 40, which may be the global position of the first vessel 40.

Thereafter the first vessel identifying device 10 transmits an identification ID of the first vessel 40, S130, which identification ID comprises the vessel identifier and the sensed position. The transmitting may be a transmitting over radio or through some other communication channel. In this embodiment the transmitting is a transmitting over radio, which is achieved through the vessel identifying function ordering the radio communication interface 20 to transmit the identification ID. The radio communication interface 20 more particularly transmits the identifier ID as a radio signal on a frequency that is assigned to the maritime tracking system.

It is thereby evident that the first ship 34, which uses AIS and thus listens to the above-mentioned frequency, will be made aware of the first vessel 40 even though the first vessel 40 does not transmit any identifier itself.

Figure 9:
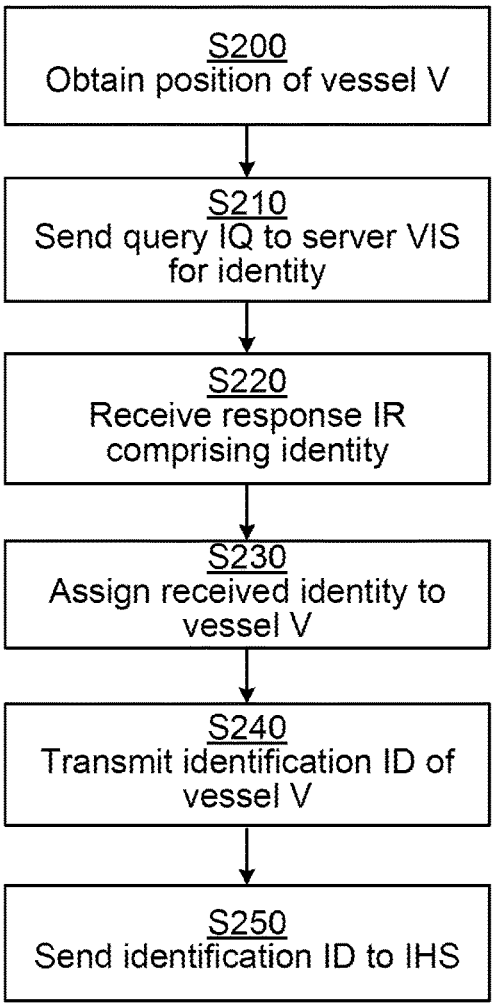
FIG. 9 shows a flow chart of a number of method steps in a second embodiment of a method for identifying vessels.

Now a second embodiment will be described in relation to FIG. 9 for the same situation depicted in FIG. 7. FIG. 9 shows a number of steps in a flow chart of the method of identifying vessels, which method is also carried out by the first vessel identifying device 10.

The vessel identifying function of the first vessel identifying device 10 obtains the sensed position of the first vessel V 40 in the same way as in the first embodiment, S200. The vessel identifying function then assigns an identity to the vessel 40 according to an identity assigning scheme of at least a part of the AIS system. In this case it sends an identity query IQ to the identity handling server 32, S210, i.e. a query for an identity to be assigned to a vessel in the AIS system, which query IQ is sent using the computer communication interface 22. The vessel identifying function thus queries the identity handling server 32 for an identity to be assigned to the first vessel 40. The query IQ may comprise the position of the vessel identification device 10 and an indication of the area in which the vessel identification device 10 is located. The query may also or instead comprise the position of the first vessel 40. The server 32 then provides an identity according to an identity assigning scheme. The identity may be linked to an area in which the first vessel 40 is located. Alternatively, the identity may be global and used in the AIS system. The identity may also here be an identity that differs from static identities assigned to vessels by the AIS system. The identity is sent in an identity response IR, which response is then received by the first vessel identifying device 10 via the computer communication interface 22, S220. The first vessel identifying device 10 then assigns the received identity to the first vessel 40, S230. Thereafter the first vessel identifying device 10 transmits an identification ID of the first vessel 40, S240, which identification ID comprises the assigned identity of the first vessel 40 and the detected position. This is also here done through the vessel identifying function ordering the radio communication interface 20 to transmit the identification ID as a radio signal on a frequency that is assigned to the AIS system. The first vessel identifying device 10 also sends the identification ID that comprises the position and the assigned identity of the first vessel 40 to the identity handling server 32, S250, which sending is made using the computer communication interface 22.

The identity handling server 32 may then provide the identification ID in a database with other vessel identifications, which database can be investigated by ships that navigate through different waters. A ship that is in the area of the first vessel identifying device 10, may thereby be notified about the first vessel 40, even though it does not use AIS.

The first vessel identifying device 10 may operate in the same way for the further ship 44. This ship has an own identifier in the maritime tracking system, that it may use for reporting its position to the identity handling server 32. Thereby, the identity handling server 32 may be notified of this ship 44 using two different identifiers. The vessel identifying server 32 may then inform the first vessel identifying device 10 that the further ship 44 already uses the maritime tracking system and that the position need not be reported by the first vessel identifying device 10.

In one variation of the second embodiment, the identification ID is not transmitted to the identity handling server 32 via the computer communication interface 32.

Figure 10:
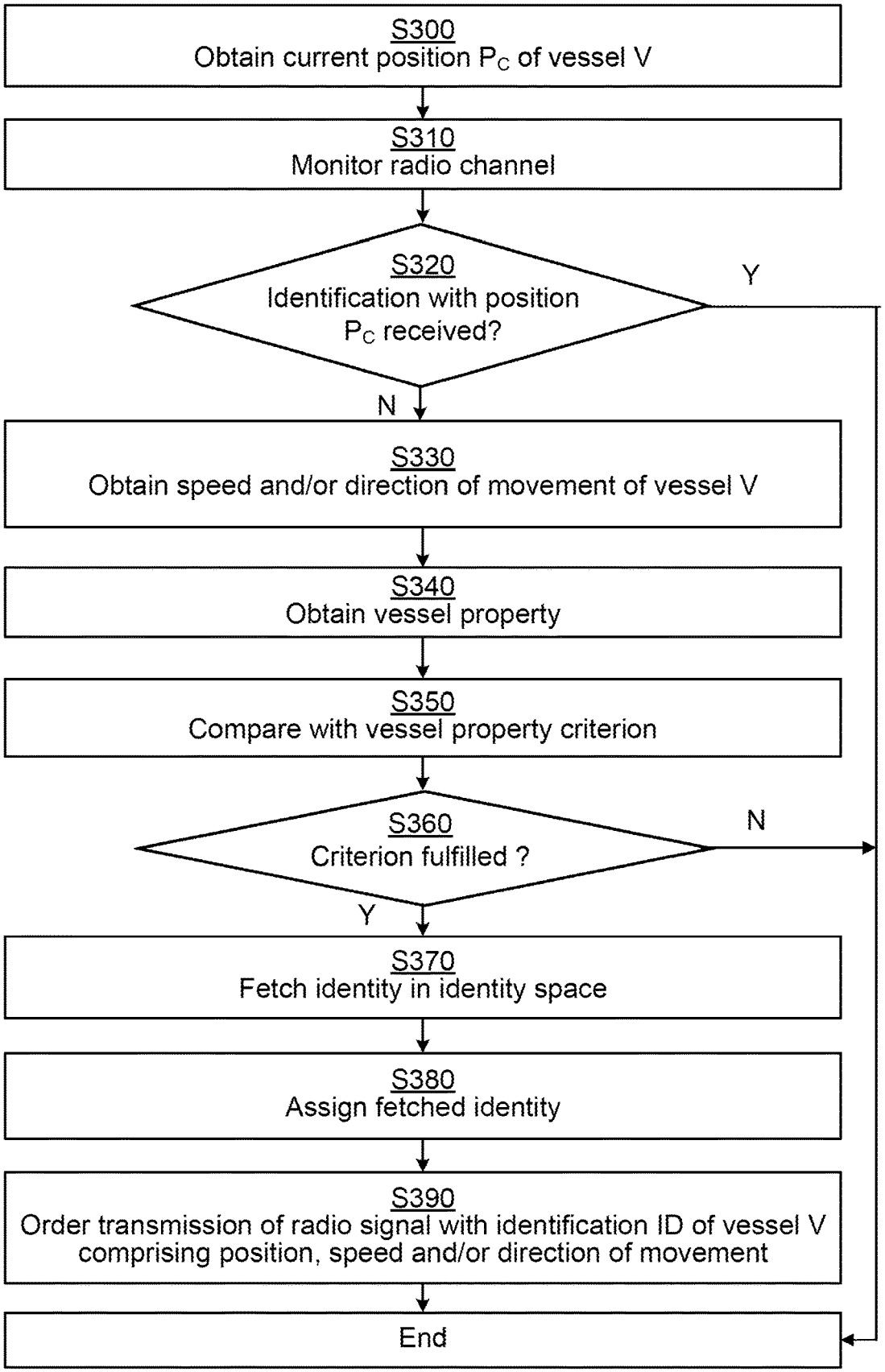
FIG. 10 shows a flow chart of a number of method steps in a third embodiment of a method for identifying vessels.

FIG. 10 shows a flow chart of a third embodiment of the method. In this embodiment the sensor 12 again senses surrounding vessels, such as the first vessel 40 and the further ship 44 and sends the positions to the vessel identifying function. The vessel identifying function then obtains the current position $P_C$ of the first vessel 40 at a current point in time, S300. In this case the first vessel identifying device 10 also has obtained a previous position $P_P$ of the first vessel 40 via the sensor 12, which previous position $P_P$ has been sensed at a previous point in time.

The first vessel identifying device 10 may optionally also monitor the radio frequency of the AIS system with regard to identifications being transmitted thereon with the current position, S310, which monitoring is performed using the radio communication interface 20. In case there is a transmission of an identification of a ship with the current position $P_C$, S320, then the method may be ended.

However, in case there is no such transmission, S320, the vessel identifying function of the first vessel identifying device 10 may continue and obtain the speed and/or the direction of movement of the first vessel 40, S330.

The obtaining may comprise determining the speed and/or direction based on a least two sensed vessel positions comprising the current and previous positions $P_C$ and $P_P$. The speed/and or direction may also be determined using the corresponding points in time. The vessel identifying function may thus use the current and previous points in time, if they are needed. For instance, the determining of the speed may be made also based on the points in time at which the positions are sensed.

Alternatively, the vessel identifying function may obtain the speed and/or direction from at least one other sensor that can directly measure the speed and/or direction.

The vessel identifying function also obtains at least one vessel property, which may be a physical property of the first vessel 40, S340. The physical property may be a quantifiable physical property, a physical quantity, or an observable. The vessel identifying function may additionally be set to only perform the assigning and the transmitter may be set to only perform the transmitting in case the vessel property fulfils a corresponding vessel property criterion.

The obtained vessel property may comprise the speed of the vessel. Additionally, or instead, the obtained vessel property may comprise the size of the vessel. The size of the vessel can for instance be estimated based on the size of an echo that bounces off the vessel. The estimated size may have an estimated width and an estimated length.

The vessel property is then compared with a corresponding vessel property criterion S350. The speed may for instance be compared with a speed criterion. If for instance the speed is below a lower speed threshold, then the vessel may be considered to be stationary, and the criterion may be considered not being fulfilled. Also, if the speed is above an upper speed threshold, then the first vessel 40 may be deemed to be a merchant ship that should employ AIS. In this case the speed criterion may also be considered not being fulfilled. However, if the speed is above the lower speed threshold and below the upper speed threshold, the speed criterion may be considered to be fulfilled.

For the vessel size, the corresponding property criterion is a size limit of the vessel. In this case the vessel property may fulfil the vessel property criterion in case the estimated vessel size is within the vessel size limit. It is also possible that the size is compared with at least one size criterion. The vessel size limit may comprise a vessel length limit and/or a vessel width limit. In this case the assigning and transmitting may only be performed in case the estimated length and/or width of the vessel is within the corresponding limit. It is for instance possible that the width of the vessel is compared with a width threshold and/or that the length of the vessel is compared with a length threshold. In case any of these thresholds or both are exceeded, the vessel may then be considered to be a merchant ship that should be equipped with the maritime tracking system, and the size criterion is not fulfilled. However, in case the width is below the width threshold and/or the length is below the length threshold, then the size criterion may be considered to be fulfilled.

If all vessel properties do not fulfil their corresponding property criterion, S360, the method may then be ended. However, if any vessel property fulfils the corresponding vessel property criterion, S360, the first vessel identifying device 10 may continue and fetch an identity in the identity space of the maritime tracking system, S370, which may again be an identity that differs from the static identities belonging to vessels in the AIS system. The first vessel identifying device 10 may then assign the fetched identity to the vessel, S380.

Thereafter the first vessel identifying device 10 orders the radio communication interface 20 to transmit the identification ID of the vessel, S390, which identification ID comprises the vessel identifier, the current position $P_C$ as well as the obtained speed and/or direction of movement of the vessel 40. In this embodiment the vessel identifying device 10 transmits the identification ID using the radio communication interface 20. It more particularly transmits the identifier ID on the radio signal frequency that is assigned to AIS.

The first vessel identifying device may operate in the same way for the further ship 44. However, this would either be detected as transmitting an AIS signal or the vessel properties would most likely not fulfil the vessel property criteria and consequently no identification would be sent for the further ship 44.

It is also possible that a second vessel identifying device, such as a second vessel identifying device on the further ship 44, detects and sends an identification of the first vessel 40 before the first vessel identifying device 10 detects the first vessel 40. In this case the first vessel identifying device 10 may initially refrain from transmitting an identification of the first vessel 40. If the further ship 44 then stops sending identifications of the first vessel 40, the first vessel identifying device 10 may start to transmit identifications of the first vessel 40, which identifications may with advantage comprise the same vessel identifier of the first vessel 40 that the second vessel identifying device used.

Figure 11:
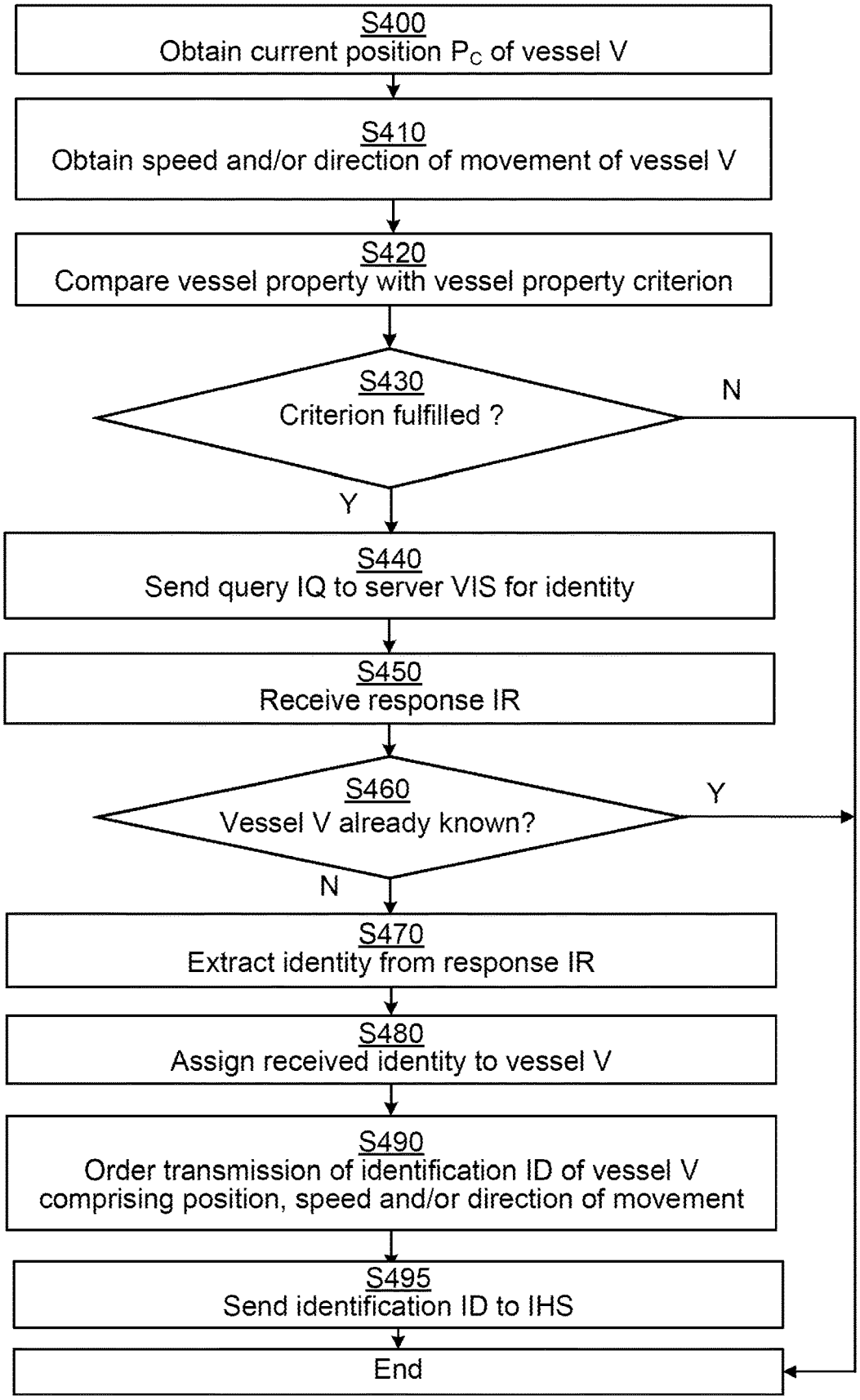
FIG. 11 shows a flow chart of a number of method steps in a fourth embodiment of a method for identifying vessels.

A fourth embodiment will now be described with reference being made to FIG. 11.

The sensor 12 again senses positions of surrounding vessels, such as the first vessel 40 and the further ship 44, which are again sent to the vessel identifying function. Thereby the vessel identifying function obtains the current position $P_C$ of the first vessel 40 at a current point in time, S400. In this case it also has a previous position $P_P$ of the first vessel 40, which has been sensed at a previous point in time.

The first vessel identifying device 10 may also here monitor the radio frequency of the maritime tracking system with regard to identifications being transmitted thereon with the current position, which monitoring is performed using the radio communication interface 20. In case there is a transmission of an identification of a ship with the current position PC, S320, then the method may be ended.

The first vessel identifying device 10 may also obtain the speed and/or the direction of movement of the first vessel 40, S410, which may again be through determining the speed and/or direction based on the current and previous positions $P_C$ and $P_P$ and the current and previous points in time if they are needed. It is also possible to use speed and/or direction sensors. The first vessel identifying device 10 then continues and obtains at least one vessel property, which is a physical property of the vessel 40, such as a quantifiable physical property, a physical quantity, or an observable.

The vessel property may again be the speed of the vessel. Alternatively, or instead, the vessel property may be the size of the vessel. The size of the vessel can for instance be estimated based on the size of an echo that bounces off the vessel.

The vessel property is then compared with a corresponding vessel property criterion, S420. The speed may for instance be compared with a speed criterion. If for instance the speed is below a lower speed threshold, then the vessel may be considered to be stationary, and the criterion may be considered not being fulfilled. Also, if the speed is above an upper speed threshold, then the vessel may be deemed to be a merchant vessel that should employ the maritime tracking system. In this case the speed criterion may also be considered not being fulfilled.

However, if the speed is above the lower speed threshold and below the upper speed threshold, the speed criterion may be considered to be fulfilled.

It is also possible that the size is compared with at least one size criterion. It is for instance possible that the width of the vessel is compared with a width threshold and/or that the length of the vessel is compared with a length threshold. In case any of these thresholds or both are exceeded, the size criterion is not fulfilled. The vessel 40 may then be considered to be a merchant ship that should be equipped with AIS. However, in case the width is below the width threshold and/or the length is below the length threshold, then the size criterion may be considered to be fulfilled.

If all vessel properties do not fulfil the corresponding property criteria, S430, the method is ended. However, if any vessel property fulfils the corresponding vessel property criterion, S430, the first vessel identifying device 10 then continues and sends an identity query IQ to the identity handling server, S440, i.e. a query for an identity to be assigned to a vessel in the AIS system, which query IQ is sent using the computer communication interface 22. The identity query IQ may comprise the position of the vessel identification device 10 and an indication of the area in which the vessel identification device 10 is located. The query may also or instead comprise the current position $P_C$ of the first vessel 40. The server 32 then sends an identity response IR to the identity query IQ, which identity response IR is received by the first vessel identifying device 10, S450. If the query comprises the current position $P_C$, the identity handling server 32 may already have knowledge about a vessel at the current position $P_C$. In this case, the response may indicate that the vessel is already known. If the vessel is already known S460, the method may be ended.

However, in case the vessel is not considered already known, S460, the response comprises an identity for the vessel 40. In this case the first vessel identifying device extracts the identity from the response, S470, and then continues and assigns the received identity to the first vessel 40, S480.

Thereafter the first vessel identifying device 10 orders the radio communication interface 20 to transmit the identification ID of the vessel, S490, which identification ID comprises the vessel identifier, the current position PC as well as the obtained speed and/or direction of movement of the vessel 40. In this embodiment the first vessel identifying device 10 transmits the identification ID using the radio communication interface 20. It more particularly transmits the identifier ID on the radio signal frequency that is assigned to AIS.

The first vessel identifying device 10 also sends the identification ID to the identity handling server 32, S495, which sending is made using the computer communication interface 22.

The first vessel identifying device may operate in the same way for the further ship 44. However, this would either be known by the identity handling server 32 to be using the maritime tracking system or the vessel properties would most likely not fulfil the vessel property criteria and consequently no identification would be sent for the further ship 44.

It is also here possible that a second vessel identifying device, for instance on the further ship 44, senses the first vessel 40 and transmits an identification of the first vessel 40 before the first vessel identifying device 10 senses the first vessel 40. In this case the first vessel identifying device 10 may initially be informed by the identity handling server 32 to refrain from transmitting identifications of the first vessel 40. If the further ship 44 then stops sending identifications of the first vessel 40, the first vessel identifying device 10 may be instructed by the identity handling server 32 to start to transmit and send identifications of the first vessel 40, which identification may with advantage comprise the same vessel identifier of the first vessel 40 that the second vessel identifying device previously used.

Aspects of the present disclosure are concerned with locating of ships without AIS transponder by using onboard, onshore, or other sensor platforms (e.g. mobile equipment, such as drones or satellites), for instance, radar, lidar or cameras, and then creating virtual AIS information for these ships and publish this virtual AIS information where other ships can use this data in their navigation. This can be done in a ship that uses AIS, where the ship acts as a proxy and sends out AIS information directly for other ships or by communicating it to some other system, here exemplified by the identity handling server, where it can be accessed. The proxy can also be installed locally in harbours or other high traffic locations by using onshore sensors to provide a better overview for ships that are approaching.

Thereby, the first vessel identifying device can be considered to be a proxy AIS, where sensors on a ship, onshore or any other platform are used to locate non-AIS vessels and broadcast AIS information for them. This means that non-AIS vessels can be detected early and be taken into consideration in the navigation for other vessels. If several ships equipped with proxy AIS are observing the same vessel, then they can all contribute information about the virtual ship with distributed sensor fusion.

Alternatively, the information is published in the identity handling server, which can be considered to form a system that stores AIS like information about all ships in a certain area or the whole world. The virtual ship identity and information sent to the system from different sources are merged in the system and published as one virtual ship. Since this alternative solution does not rely on AIS, additional properties can be shared as a complement to the AIS information. The focus is to locate and store AIS like information for ships that do not publish their information, but the system could also publish such enriched information for ships that do have an AIS transponder.

There are a number of variations that are possible apart from those already described. For instance, in the examples given above the identity handling server was used for both providing identifiers and keeping track of vessels and their positions. It should be realized that these functions could be separated and provided in different servers or in a collaborative or distributed manner.

While the invention has been described in connection with what is presently considered to be most practical and preferred embodiments, it is to be understood that the invention is not to be limited to the disclosed embodiments, but on the contrary, is intended to cover various modifications and equivalent arrangements. Therefore, the invention is only to be limited by the following claims.

The invention claimed is:

1. A method for identifying vessels, the method being performed by a vessel identifying device and comprising:

obtaining a position of a vessel sensed by a sensor, assigning by a processor an identity to the vessel, which identity is assigned according to an identity assignment scheme of at least a part of a maritime tracking system, which maritime tracking system is an Automated Identification System (AIS), and ordering transmitting of an identification of the vessel according to the maritime tracking system, the identification including the assigned identity and the position of the vessel.

2. The method as claimed in claim 1, further comprising obtaining a speed and/or direction of movement of the vessel and where the transmitting includes transmitting the obtained speed and/or direction of the vessel.

3. The method according to claim 1, further comprising fetching an identity in an identity space of the identity assignment scheme, wherein the assigning includes assigning the fetched identity to the vessel.

4. The method as claimed in claim 1, further comprising querying a server associated with the maritime tracking system and receiving the identity as a response to the query, wherein the assigning includes assigning the received identity to the vessel.

5. The method as claimed in claim 1, wherein the transmitting comprises transmitting the identification as a radio signal on a frequency assigned to the maritime tracking system.

6. The method according to claim 1, further comprising sending the identifier to a central server that collects and stores identifiers of vessels for at least a part of the world.

7. The method as claimed in claim 1, wherein the detected position of the vessel is a local position that is related to a position of the vessel identifying device and further including determining a global position of the vessel based on the position of the vessel identifying device and where the position in the transmitted identification includes the global position of the vessel.

8. The method as claimed in claim 1, further comprising obtaining at least one vessel property and only performing the assigning and transmitting in case the vessel property fulfils a corresponding vessel property criterion.

9. The method as claimed in claim 8, wherein the obtaining of at least one vessel property includes estimating a size of the vessel for which the corresponding property criterion is a size limit of the vessel, and where the vessel property fulfils the vessel property criterion in case the estimated vessel size is within a vessel size limit.

10. The method as claimed in claim 9, wherein the vessel size limit comprises a vessel length limit and/or a vessel width limit and only performing the assigning and transmitting in case the length and/or width is within the corresponding limits.

11. The method according to claim 8, further comprising obtaining a speed and/or direction of movement of the vessel and where the transmitting includes transmitting the obtained speed and/or direction of the vessel, wherein one vessel property is the speed of the vessel for which a corresponding speed criterion is fulfilled if the speed is below a corresponding upper speed threshold.

12. A vessel identifying device comprising a processor operative to:

obtain a position of a vessel being sensed by a sensor, assign an identity to the vessel, which identity is assigned according to an identity assignment scheme of at least a part of a maritime tracking system, which maritime tracking system is Automated Identification System (AIS), and, provide an identification of the vessel according to the maritime tracking system, the identification including the assigned identity and the position of the vessel, and order a transmitter to transmit the identification of the vessel.

13. The vessel identifying device according to claim 12, wherein the processor is further operative to obtain a speed and/or a direction of movement of the vessel and where the identification includes the obtained speed and/or direction of the vessel.

14. A floating object, such as a ship or a buoy, comprising the vessel identifying device having a processor operative to:

obtain a position of a vessel being sensed by a sensor, assign an identity to the vessel, which identity is assigned according to an identity assignment scheme of at least a part of a maritime tracking system, which maritime tracking system is an Automated Identification System (AIS), and, provide an identification of the vessel according to the maritime tracking system, the identification including the assigned identity and the position of the vessel, and order a transmitter to transmit the identification of the vessel.

15. A land installation comprising the vessel identifying device having a processor operative to:

obtain a position of a vessel being sensed by a sensor, assign by the processor an identity to the vessel, which identity is assigned according to an identity assignment scheme of at least a part of a maritime tracking system, which maritime tracking system is an Automated Identification System (AIS), and, provide an identification of the vessel according to the maritime tracking system, the identification including the assigned identity and the position of the vessel, and order a transmitter to transmit the identification of the vessel.

16. The method according to claim 2, further comprising fetching an identity in an identity space of the identity assignment scheme, wherein the assigning includes assigning the fetched identity to the vessel.

17. The method as claimed in claim 2, further comprising querying a server associated with the maritime tracking system and receiving the identity as a response to the query, wherein the assigning includes assigning the received identity to the vessel.

18. The method as claimed in claim 2, wherein the transmitting comprises transmitting the identification as a radio signal on a frequency assigned to the maritime tracking system.

19. The method according to claim 2, further comprising sending the identifier to a central server that collects and stores identifiers of vessels for at least a part of the world.

20. The method as claimed in claim 2, wherein the detected position of the vessel is a local position that is related to a position of the vessel identifying device and further including determining a global position of the vessel based on the position of the vessel identifying device and where the position in the transmitted identification includes the global position of the vessel.

* * * * *